US007997043B1

(12) United States Patent
MacMillan et al.

(10) Patent No.: US 7,997,043 B1
(45) Date of Patent: Aug. 16, 2011

(54) SYSTEM AND METHOD FOR INSTALLATION OF DECORATIVE MOLDING

(76) Inventors: Robert MacMillan, Perkasi, PA (US); Jeremy P. Hoffman, Philadephia, PA (US)

( * ) Notice: Subject to any disclaimer, the term of this patent is extended or adjusted under 35 U.S.C. 154(b) by 195 days.

(21) Appl. No.: 12/130,912

(22) Filed: May 30, 2008

Related U.S. Application Data

(60) Provisional application No. 60/940,874, filed on May 30, 2007, provisional application No. 60/976,441, filed on Sep. 30, 2007, now abandoned.

(51) Int. Cl.
*E04C 2/38* (2006.01)
*E04F 19/02* (2006.01)
*E04F 19/04* (2006.01)

(52) U.S. Cl. ..... 52/716.8; 52/718.01; 52/718.04; 52/718.05; 52/718.06; 52/311.2

(58) Field of Classification Search ..... 52/311.1, 52/311.2, 311.3, 312, 313–316, 716.1, 716.8, 52/717.01, 718.01, 718.04, 717.05, 718.05, 52/718.06, 717.04
See application file for complete search history.

(56) References Cited

U.S. PATENT DOCUMENTS

| | | | | |
|---|---|---|---|---|
| 1,925,418 | A * | 9/1933 | Swank | 52/282.3 |
| 3,113,624 | A * | 12/1963 | Haggott et al. | 169/5 |
| 3,221,452 | A * | 12/1965 | Gregoire | 52/95 |
| 3,309,832 | A * | 3/1967 | Filsinger | 52/610 |
| 3,423,894 | A * | 1/1969 | Richardson | 52/241 |
| 4,297,064 | A * | 10/1981 | Berndtson | 411/470 |
| 4,899,509 | A * | 2/1990 | Power | 52/238.1 |
| 5,463,835 | A | 11/1995 | Wood | |
| 6,341,458 | B1 * | 1/2002 | Burt | 52/287.1 |
| 6,643,990 | B2 | 11/2003 | Jensen | |
| 7,200,970 | B2 * | 4/2007 | Koenig et al. | 52/287.1 |
| 7,487,623 | B2 * | 2/2009 | Rodolofo et al. | 52/716.1 |
| 2004/0247917 | A1 * | 12/2004 | Mendes | 428/530 |
| 2005/0172571 | A1 * | 8/2005 | Koenig et al. | 52/718.01 |
| 2006/0120799 | A1 | 6/2006 | Clements et al. | |
| 2006/0196144 | A1 | 9/2006 | Spek | |
| 2007/0199270 | A1 * | 8/2007 | Weir et al. | 52/506.01 |

* cited by examiner

*Primary Examiner* — Jeanette E. Chapman
(74) *Attorney, Agent, or Firm* — Charles A. Wilkinson; Clinton H. Wilkinson

(57) ABSTRACT

A molding system for use in interior spaces for use either with new construction or finished spaces, and in addition can be used with either a suspended ceiling or conventional ceiling, whereby the molding is incorporated with the wall and ceiling surfaces in such a manner that the joints with the ceiling and wall are plumb and being mounted such that the decorative molding surface of the molding can be installed in a finished form that does not require further finishing after installation.

13 Claims, 4 Drawing Sheets

Fig. 2
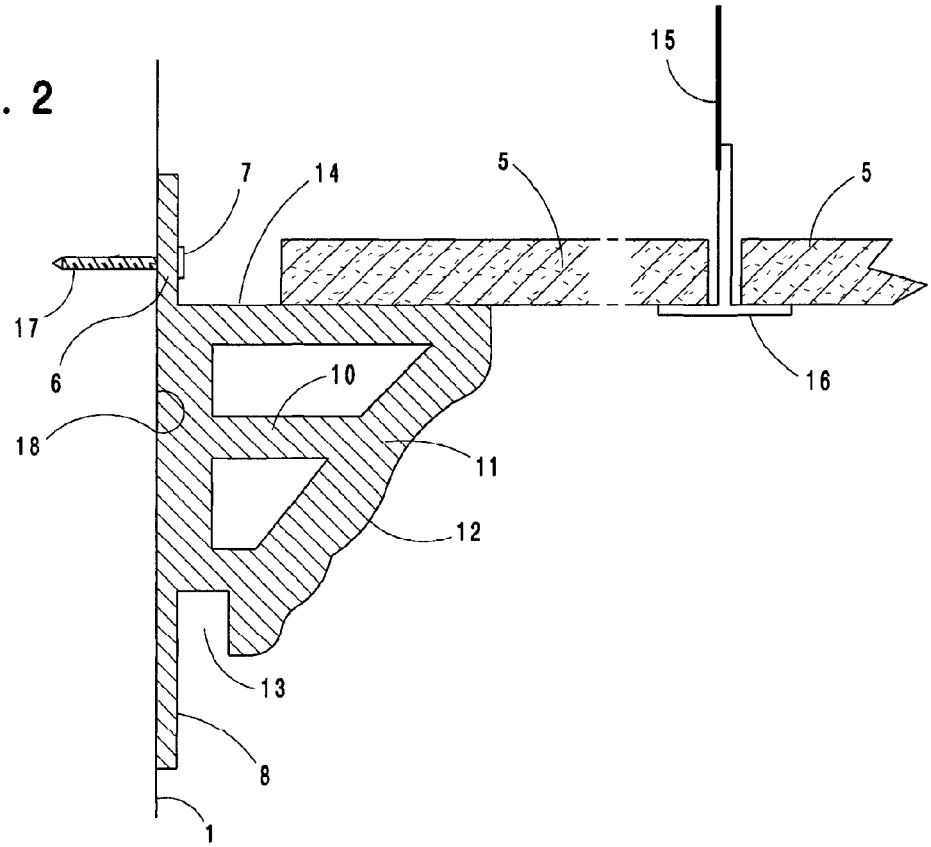
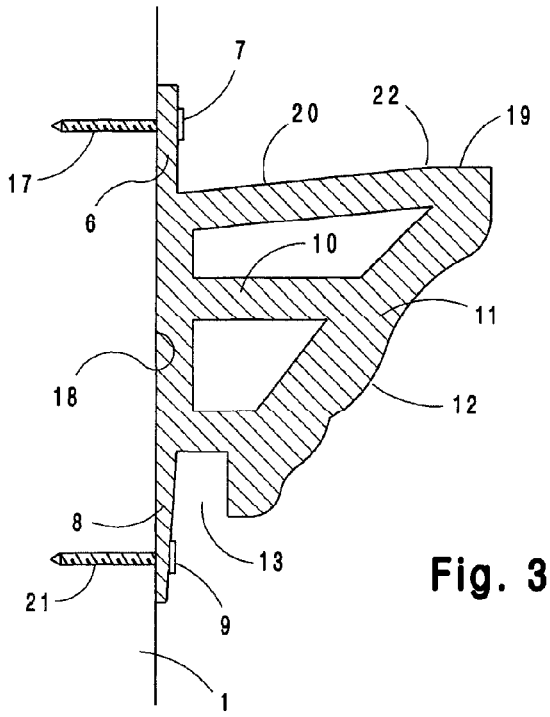
Fig. 3

Fig. 4
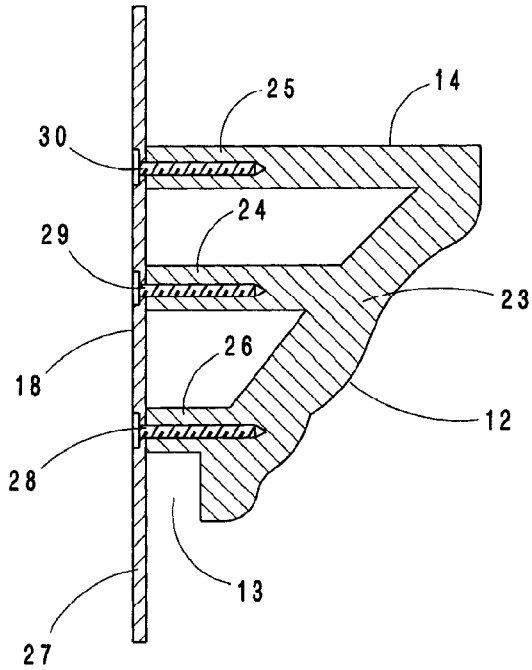
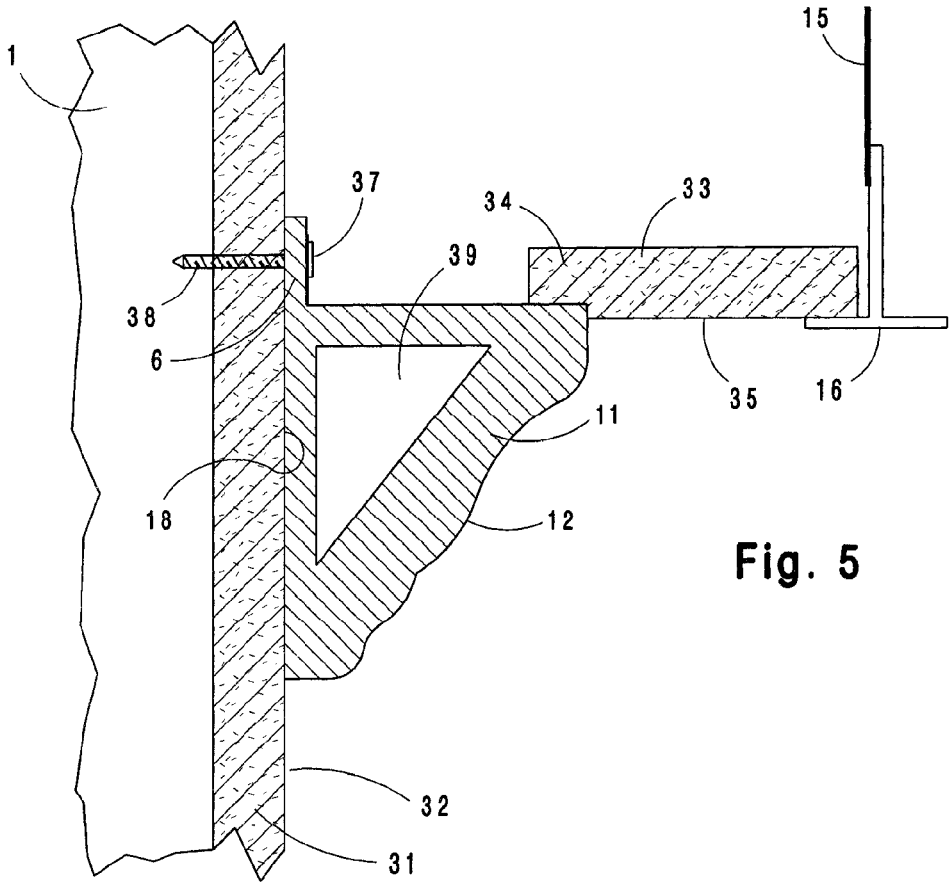
Fig. 5

SYSTEM AND METHOD FOR INSTALLATION OF DECORATIVE MOLDING

CROSS REFERENCE TO RELATED APPLICATIONS

This application claims the benefit of provisional applications 60/940,874 filed on May 30, 2007 and 60/976,441 filed on Sep. 30, 2007, the disclosures of which are incorporated by reference in their entirety

BACKGROUND

The present invention is directed to systems and methods for installing decorative molding in a building's interior space, and more particularly to a molding assembly and method of installing molding more quickly and easily in either a new construction or finished interior space, and for installing molding in an interior space having a suspended ceiling.

It is often desirable for buildings' interior spaces to have decorative trim at the top of interior walls. This is usually where the walls meet the ceiling and can be referred to as crown molding. When a building is being built, crown molding is usually installed after nearly all other construction is complete. The timing may be undesirable as there are usually many different types of finishing work that must be coordinated at the same time. Further, many interior spaces require that a suspended ceiling be used, usually to provide ready maintenance access to ventilation and other equipment. Since the suspended ceiling is not structural, the usual method of attaching crown molding to the wall and ceiling does not work. To compensate a support block must be made to provide an attachment point to the wall, at the top of the molding, near the ceiling. This method adds time and complexity to the process, as well as cost.

Further, crown molding can be added as a decorative addition to an interior space that is already completed and in use. Many times, this is done by individual homeowners to improve the appearance of the space. Installing crown molding can prove a difficult task for a nonprofessional installer. Because of the angle of the molding between the wall and ceiling, making proper corner joints requires precise measurements prior to cutting. A preferred method for installing corner joints is accomplished by scribing the profile of the adjoining surfaces and coping the proper angle—a difficult task for an inexperienced installer. Also, because the molding is attached by fasteners through the decorative face, finishing work must be performed to fill holes.

There are several methods in the current art to address these issues. The example described in U.S. Pat. No. 5,463,835 to Wood illustrates a method for affixing crown molding without attaching to the ceiling surface (see FIG. 4). This method, however, still requires that the walls are built and finished, still pushing the timing to the critical finishing period of construction. Further, the method described in U.S. Pat. No. 5,463,835 also requires the installer to calculate the proper angles to ensure proper assembly. Also note that the method described in FIG. 4 requires several discrete components (not including fasteners).

Another method, detailed in application Ser. No. 11/074,231 by Spek (filed Mar. 7, 2005), requires two interlocking pieces which form the support and face of the molding. This method addresses the difficulty of making suitable cuts resulting in good corner joints by including a system of pre-made corners (see FIGS. 6a, 6b, 7 and 8). Again, similar to the Wood patent discussed above, this method assumes the wall is finished before installation.

In U.S. Pat. No. 6,643,990 B2, inventor Jensen describes a one-piece system that is adhered to the ceiling as a method of support (see FIG. 4). This would not be useful in an application where a suspended ceiling is to be used. Further, the lack of any internal support structure limits the load that can be applied to the molding.

In U.S. Pat. No. 7,200,970 inventor Koenig describes a molding system that attaches to a constructed, but not finished wall (or ceiling) surface. After the molding is attached to the panel, finishing work (standard to the art) finishes the wall/ceiling surface at the molding, concealing the fasteners and attachment flange. Although this method does incorporate the molding into the finished wall, it does not allow for the molding to be installed prior to wall/ceiling panel installation. Further, the finishing process for wall panels is a time consuming process. It would be desirable to be able to install crown molding in such a way that requires no finishing at the crown molding.

U.S. patent application Ser. No. 11/336,235 (Clements et al.; filed Jan. 20, 2006) describes a system of hiding fasteners used to affix molding to walls and/or ceilings. Note that this method relies on standard installation practices and molding styles with the added functionality to hide the fasteners within the decorative face. As applied to crown molding in the application, the molding angles must still be calculated to form correct corners. Further, the fasteners are described as being set into a "kerf". This kerf is described as running horizontally the length of the molding, with two used at different heights on the decorative face of the molding. This allows two fasteners, one high and one low, to be placed through the decorative face of the molding affixing the molding to the wall and ceiling (see FIGS. 15, 16 and 17). Note that the kerf described has a width and a depth, and is not located at either the top or bottom edge of the molding. Also note that the means for filling the kerf does not provide any support function, and provides no decorative functionality beyond filling the kerf and hiding the fasteners.

BRIEF SUMMARY OF THE INVENTION

The present invention makes installation of crown molding easier in both new construction as well as improvement of existing interior spaces. The invention impacts new construction particularly where an interior space must have a suspended ceiling. The invention first involves a structure that places the decorative face of the molding at the correct angle to the vertical wall surface. By having the decorative face affixed at the correct angle, cutting the molding to create corner junctions is greatly simplified. Instead of calculating compound miters based on the angle of the molding to the wall and the wall corner angle, the installer must simply measure the angle at the wall junction.

When the invention is to be used for new construction with a suspended ceiling, the molding assembly is designed to be affixed to the wall support structure before the wall panels are installed. Most often this is a stud support structure. This invention includes extending the vertical surface of the molding assembly above the height of the decorative face, providing an attachment surface through which a fastener can affix the molding assembly to the studs. The area above the wall, between the suspended ceiling and the bottom of the joists, is generally unfinished space containing wiring, ventilation or other equipment, and is not seen from the finished interior space. By using the upper flange as an attachment point (the bottom flange may also be used) the weight of the molding assembly will press into the stud, in addition to the force of the upper fastener. This invention includes a vertical channel running the length of the molding assembly. This channel is designed to have a wall panel placed against the wall for installation, and then slid up the studs and into the channel for installation. The decorative face of the molding assembly starts at the side of the channel opposite the stud. Once the wall panel is in place, it is attached to the studs using standard practices. This provides a clean joint between the decorative face of the molding assembly and the wall panel. Additionally, by filling the channel, support is provided to the molding assembly further anchoring it to the studs.

Once the molding system has been affixed to the wall studs, the suspended ceiling can be installed. This is because the ceiling tiles as well as the peripheral framing can rest on the top edge of the decorative face of the molding system. Note that this also provides a finished joint between the ceiling and the crown molding.

The benefits of the present invention in new construction with a suspended ceiling include also process and timing benefits. Because the molding assembly is installed directly to the wall's support structure, it can be installed before the wall panels are installed. This could be accomplished while other tasks (such as electrical work, plumbing, insulation, etc.) are being performed that require the open wall structure. This means that adding crown molding to a new project may not mean adding time to the overall project. Further, the ceiling installation no longer needs to wait for the walls to be finished, saving process time.

Another way the present invention saves time is by a lack of finishing work required. None of the fasteners used to affix the molding assembly ever go through the decorative face. This saves considerable time and labor. Also, the molding can be painted before it is installed, since the decorative face is never violated by the process.

In addition to being used in new construction, the present invention can also be used to improve an existing interior space. For a space with a suspended ceiling, or for an existing space where a suspended ceiling is to be installed, the assembly is as described above, but with no channel for a wall panel at the bottom. Thus, the vertical surface that attached to the wall has an attachment point extending above the height of the decorative face (and hidden by the suspended ceiling), but in this case the vertical surface terminates at the bottom of the decorative face. There is no lower attachment point for this example. For this suspended retro-fit example the bottom of the decorative face is the bottom of the molding assembly, and terminates at the wall surface. As above, when the suspended ceiling is placed, the weight of the ceiling holds the molding assembly to the wall, in addition to the upper fastener.

The present invention can also be used in an existing interior space without a suspended ceiling and with a standard fixed ceiling. Here the molding assembly has a lower attachment point, and no upper attachment point. The vertical mounting surface of the molding assembly does not extend above the height of the decorative face (and may be slightly below). The lower channel exists in this example, but not to accommodate a wall panel. The vertical mounting surface extends below the decorative face of the molding assembly and provides an attachment point. A vertical channel will run the length of the molding inside the bottom edge of the decorative face. This channel will likely be thinner, as more material will be needed on the flange to strengthen and provide support from the lower attachment point for the molding assembly. This example also includes a second piece that fills the vertical channel, hides the fastener and lower attachment point. This second piece also provides increased rigidity by filling the vertical channel and preventing the molding assembly from sagging and pulling the top edge of the decorative surface away from the ceiling. Also, the outer surface of the second piece will be a decorative face, and will complete the crown molding's decorative face from the start of the channel to the wall surface below the lower attachment point. The second piece will be retained in the channel by any existing method for doing that, such as a ridge on the second piece and a matching notch in the molding assembly.

BRIEF DESCRIPTION OF THE DRAWINGS

FIG. 2 is a cross sectional view of an embodiment of the present invention. In this embodiment a single attachment point attaches to the wall structural members. This figure also illustrates placement of a suspended ceiling frame and tiles. The wall panel itself is not included in this figure.

FIG. 3 is a cross sectional view of an alternative embodiment of the present invention using both a high and a low attachment point to the wall structural members. This figure also illustrates some different contours and angles for the supporting structure of the system. Neither the wall panel nor the ceiling tiles are included in this figure.

FIG. 4 is a cross sectional view of another embodiment of the present invention which joins two different pieces together to form the system. Neither the wall panel nor the ceiling tiles are included in this figure.

FIG. 5 is a cross sectional view of another embodiment of the present invention illustrating the molding system attached to an already assembled wall. This figure also illustrates placement of a suspended ceiling frame and tiles.

DETAILED DESCRIPTION OF THE INVENTION

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. Reference will now be made in detail to the preferred implementation of the present invention as illustrated in the accompanying drawings. Wherever possible, the same reference numbers will be used throughout the drawings and the following description to refer to the same or like parts.

Figure 1:
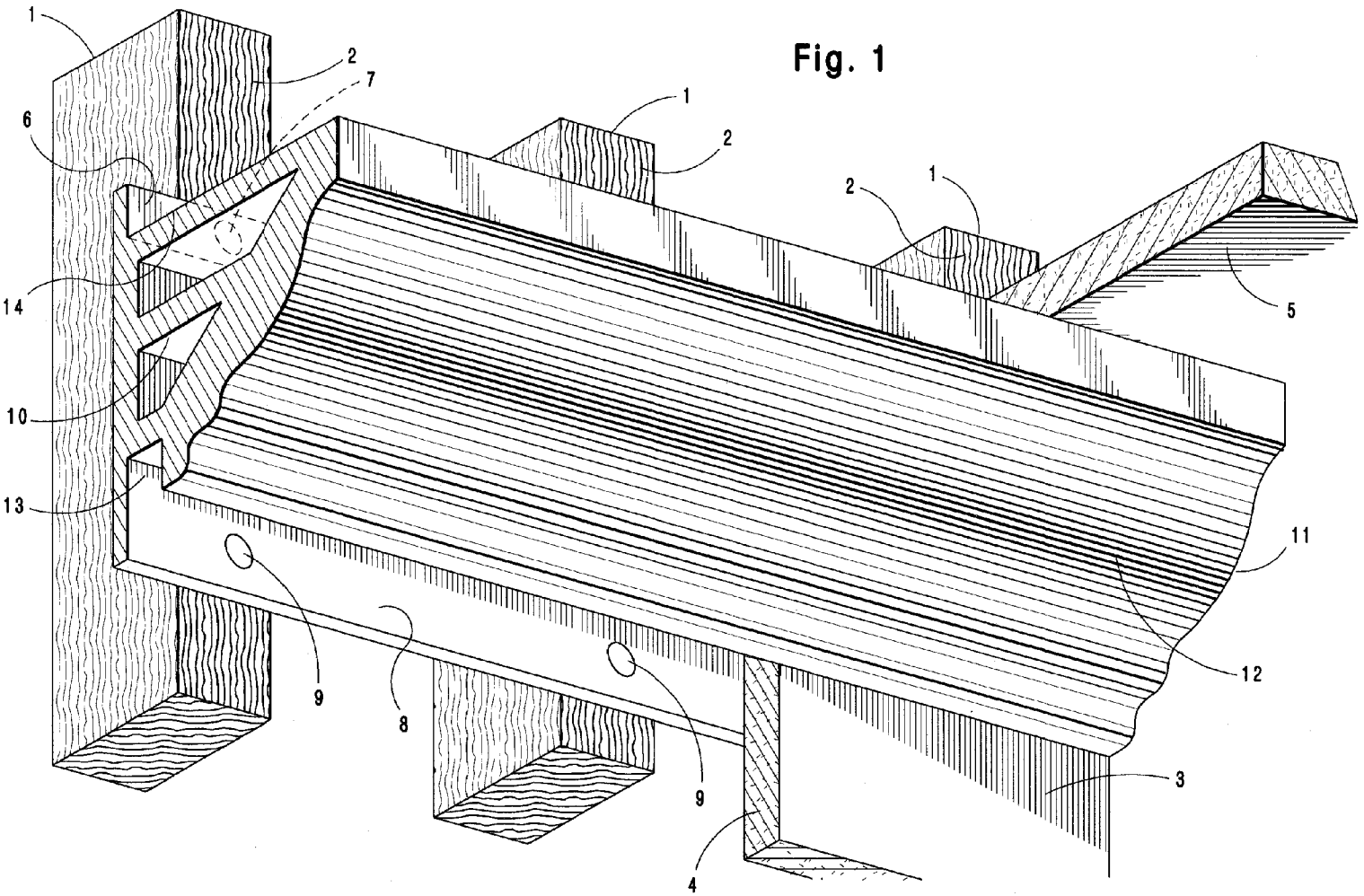
FIG. 1 is a perspective view of a first preferred embodiment of the present invention. This view illustrates the longitudinal nature of the invention (from left to right in this figure) and although the length in this figure is short, in practice the invention may extend as long as necessary. In the foreground the wall studs to which the invention is affixed are visible, as well as the fastener locations. Mounting hardware and structural wall members are exposed for illustrative purposes. This figure also shows the placement of a wall panel and a ceiling panel on the right side of the figure.

FIG. 1 provides a perspective view of a decorative molding system embodying the principles and concepts of the present invention. Reference numeral 11 designates generally the invention itself as described in this embodiment. Although the representation of length in FIG. 1 is finite, it will be understood that the molding system may extend longitudinally as needed. Usually this length is the length of the wall on which this system will be installed. In this embodiment, the main structure 11 is one piece and the entire system for this embodiment comprises only one piece. Fasteners are not denoted as part of the system in this embodiment. The system's structure 11 is a rigid structure having a decorative front surface 12, upper surface 14, and a rear surface 15, being held together by an arbitrary internal support structure 10. As such, the internal support structure 10 serves to ensure that decorative surface 12 is held rigid and fixed with respect to the vertical mounting surface 18 (see FIG. 2 for 18). Arbitrary support structure 10 will also maintain the rigidity of the structure 11 such that upper and lower attachment flanges 6 and 8 located above upper surface 14 and below decorative surface 12, respectively, remain in a fixed orientation. In addition, a vertical channel 13 is provided behind the lower edge of decorative surface 12 and flange 8. The exact structure of the internal support structure 10 will be determined using standard materials science and engineering, and will depend on the needs of the materials chosen. It is specified here that the internal support structure 10 must be strong enough to support all of the components of the molding system 11 in proper orientation with the necessary components of a suspended ceiling, including ceiling tile 5, resting on the upper contact surface 14.

One of the benefits of the present invention is that achieving the necessarily precise cuts of the molding structure 11 is much improved over ordinary decorative crown molding. This benefit is achieved because the main structure 11 of the molding assembly is rigid, and thus always maintains the correct angle of the decorative face 12 to the vertical mounting surface 18 (see FIG. 2 for 18).

Reference numeral 1 identifies the wall structural members, hereon referred to as studs. There are three studs visible in FIG. 1, but any number may be present in a structure's walls, depending on wall length, building codes and other factors. Studs 1 have an outer surface 2 onto which the molding system 11 will be affixed. Note that the outer surface 2 of studs 1 is the same surface onto which the wall panel 3 will be affixed. The molding assembly is affixed to studs 1 using any standard fasteners 7 and 9. In this embodiment, one fastener 7 will penetrate through the upper attachment flange 6 of main structure 11 at each location of a stud 1 along the length of the installation of the molding system. Also, fasteners 9 will be used in a similar manner as fastener 7, however they will penetrate through the lower attachment flange 8. In this embodiment fasteners 7 and 9 may be screws or nails of common nature. Holes for fasteners 7 and 9 may be drilled, as pilot holes are commonly used, before the fastener is placed. Alternately the screw or nail may be used to create its own hole as it is used. The choice to drill a hole through attachment flanges 6 and 8 may be made by the installer or determined by the qualities of the material used to manufacture molding assembly 11. In addition, the choice of fasteners 7 and 9 and the method of use may vary depending on the needs of the material used in this embodiment, and standard practices for attaching those materials.

Once molding system 11 in FIG. 1 is affixed to the studs 1, the wall panels can be placed. In this embodiment wall panel 3 is a standard panel such as a gypsum wallboard panel. The wallboard 3 is of uniform thickness 4, except for the common practice of including tapered seams at two of the edges of the wallboard. One of these seams can be easily removed for this embodiment if necessary. The horizontal width of the vertical channel 13 in molding system 11 matches the width of the wallboard, or is slightly wider as needed, such that when wall panel 3 is placed against the stud surfaces 2, wall panel 3 can be slid up stud surfaces 2, sliding over lower attachment flange 8 and fasteners 9 and into vertical channel 13. Once wall panel 3 has been seated in vertical channel 13, the wall panel will be affixed to stud surfaces 2 using standard practices for gypsum wall panel installation.

When wall panel 3 has been attached to stud surfaces 2, the junction between wall panel 3 and decorative face 12 should be a finished surface, albeit unpainted, with no wall finishing work such as spackling necessary for this joint. This provides a labor saving advantage over traditional crown molding installation. Further, note that the crown molding system 11 has been installed without any fasteners, or other procedures, damaging or penetrating decorative face 12. This is also a labor saving advantage as there are no fastener holes to be filled, as is the case with traditional crown molding.

Benefit can also be gained through moving the installation of this crown molding system earlier in the process than is possible with other methods of crown molding installation. This is due to the fact that molding system 11 is affixed directly to the wall structural members 1. Thus, unlike traditional crown molding installations, the present inventor's crown molding system can be installed at any point after the wall framing is complete. This allows for the crown molding installation to be moved from the end of the construction process, where many finishing jobs need to be done and may conflict, to a point in the construction where very little finishing work is to be done. Before wall panels can be attached to framing there are many jobs that must be accomplished. These include electrical and plumbing, among others. Thus, using the present inventor's system the crown molding can be installed before the wall panels are installed, possibly at the same time as electrical work and plumbing are being done. This can be a benefit as it does not add to process time during a building project.

Further benefit of the invention comes from the ability to finish the decorative surface 12 before installation of the wall panels. Because decorative surface 12 is never marred by the installation process, it can be finished before installation and expected to appear finished at project completion, barring construction accidents or mishaps. Paint can be used as the finish of choice in this embodiment. Paint can be applied either before installation, or can be applied after installation, but before wall panel installation for labor savings. If spraying is the method of application, the painter must only worry about adequately covering decorative surface 12. Further, the painter does not need to be concerned about over spray as none of the other components of the molding system will be visible upon project completion. The benefits of spray application also apply to painting after molding system installation, but before wall panel or ceiling installation. Some overspray may exceed molding system 11, but any over spray will be hidden by the wall panels and ceiling once installed.

In addition to paint, the invention as described in this embodiment may also have a wood-like sticker applied to decorative surface 12, or color throughout if colorable materials are used in manufacturing.

Installing molding system 11 also allows for the suspended ceiling to be installed before the wall panels are installed. This is ordinarily not possible, as the frame for the suspended ceiling is usually attached to the finished wall panel where the wall meets the ceiling. By using the present inventor's molding system 11 the builder gains the flexibility to install the frame for the suspended ceiling, and the ceiling tiles 5, anytime thereafter.

FIG. 2 is a cross sectional view of the present invention in a similar embodiment to that illustrated in FIG. 1. Included in FIG. 2 are depictions of two ceiling tiles 5, as well as suspended ceiling framing member 16 and suspending wire 15. In this embodiment the ceiling tiles 5 and framing members 16 that extend to the junction of the ceiling and molding system 11 will come to rest on the upper contact surface 14. This will form the finished joint between the ceiling and molding system 11.

The function of the invention as illustrated in FIG. 2 is similar to that described for the embodiment in FIG. 1, with a few differences. For illustrative purposes, the shaft 17 of fastener 7 is visible. In this case, a screw is shown as it has penetrated the upper attachment flange 6 and stud 1. Also, the embodiment illustrated in FIG. 2 does not use a fastener through lower attachment flange 8. This illustration does show how vertical mounting surface 18 will rest directly on stud surface 2. It should also be noted that the thickness of the lower attachment flange in this embodiment may be thinner than that portrayed in FIG. 2. This may be desirable to keep wall panel 3 (see FIG. 1) as plumb as possible.

FIG. 3 illustrates another embodiment of the present invention that functions similarly to the previous embodiments. In FIG. 3, shafts 17 and 21 of fasteners 7 and 9, respectively, are shown, which fasteners in this embodiment are nails. Also note that the lower attachment flange 8 is tapered to be narrower at the bottom of vertical channel 13. This taper may more easily accommodate insertion of wall panel 3 (see FIG. 1) so it is closer to plumb after it is installed. FIG. 3 also depicts a smaller upper contact surface 19. Upper contact surface 19 is horizontal, and is the surface upon which the ceiling will rest. At point 22 upper surface 20 angles away from the horizontal to meet upper attachment flange 6 at a lower point on molding system 11.

FIG. 4 illustrates another embodiment of the molding system of the present invention whose function and use are very similar to the previous embodiments, but whose construction is different. In this embodiment, the molding system is comprised of two joined pieces, namely main structure 23 and plate 27. These can be dissimilar materials. In one implementation, plate 27 is made from metal, and structure 23 is made from another material such as a plastic or a rigid foam. These two components are joined in the manufacturing process by fasteners 28, 29 and 30. The fastening of the two components is accomplished using fasteners known in the art to be able to join these two components into a rigid structure. As in the other embodiments, the design of the internal supports 24, 25 and 26 will be such that the entire molding assembly is rigid as described above.

A key advantage of the embodiment as illustrated in FIG. 4 is the ability to construct the invention to be part of a fire resistant wall. There are many situations in which building codes will require an interior wall to be fire resistant. This embodiment could increase the fire resistance of the invention by using metal, or other fire resistant materials, for plate 27. Fire resistance could be achieved by using fire resistant wall panels in the manner described above. In addition, fire resistant wall panels could be installed on the studs above the molding system, and continuing to the bottom of the roof. By resting the bottom of the fire resistant wall board panel on upper contact surface 14, it can be ensured that the wall is covered from roof to floor with fire resistant materials.

FIG. 5 illustrates another embodiment of the present invention that is designed to be installed onto an already finished wall, and in addition provides support for a suspended ceiling. While this embodiment does not enjoy the advantages achieved during construction of the previous embodiments, it does offer advantages for those wishing to install crown molding in existing interior spaces with a suspended ceiling. Note that the benefits related to the simplicity of angled cuts for corners are realized with this embodiment, as decorative face 12 is always held rigid and fixed with respect to vertical mounting surface 18. Note also that the internal structure 39 is simplified, as no cross pieces are provided. As before, the only requirements for internal structure 39 as it relates to this invention is that it maintains the rigidity of the entire molding system 11, including the upper attachment flange 6 and all other components.

Fastener 37 in FIG. 5 is used to affix molding system 11 with shaft 38 penetrating upper attachment flange 6 as well as wall panel 31 and fastening into stud 1. Note that in addition to the force of fastener 37, the weight of molding system 11 will press vertical mounting surface 18 against finished wall surface 32. The weight of ceiling tile 33 resting on upper contact surface b will also contribute force seating molding system 11 against finished wall surface 32.

Although any commonly used ceiling tile application can be used with the present inventor's molding system, ceiling tile 33 illustrates a commonly used type of ceiling tile whose decorative face 35 protrudes below the suspended ceiling framing member 16 and the upper contact surface 14. Ceiling tile of this type is supported by recessed surfaces 34.

Figure 6:
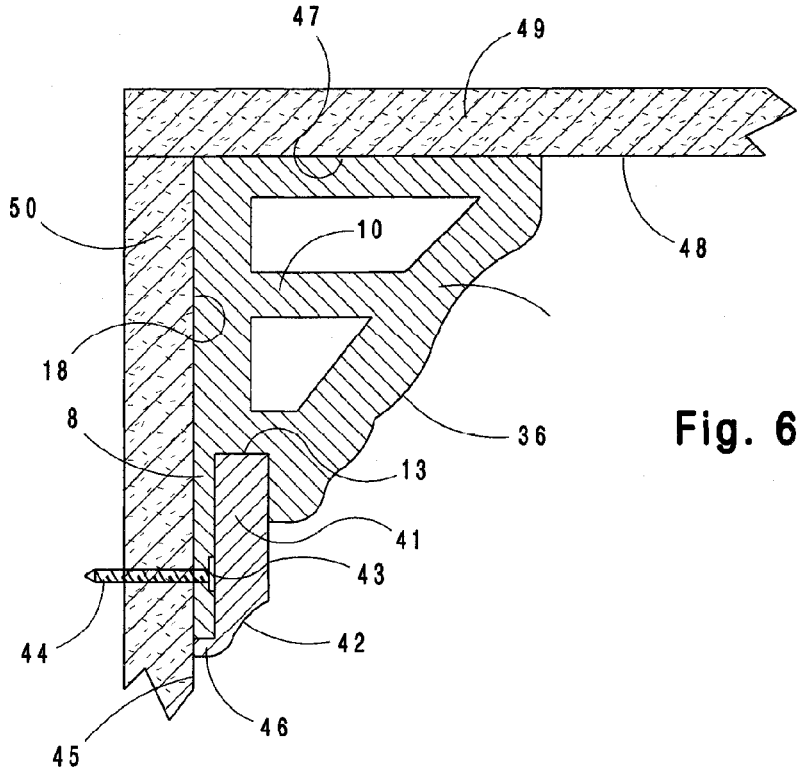
FIG. 6 is a cross sectional view of another embodiment of the present invention in which the molding system is affixed to a finished wall and against a finished ceiling. The figure illustrates a rigid ceiling, not a suspended or removable ceiling. This figure also includes the decorative lower structure, which is inserted after the main structure is attached to the wall.

FIG. 6 illustrates an embodiment of the present invention for installing the molding system in an interior space whose wall panels have already been installed, and in addition which uses a fixed rigid ceiling with the ceiling panels already installed. In most cases, this embodiment will be used where the wall and ceiling surfaces have already been finished. This is a type of interior space common to many residences.

This embodiment differs from previous embodiments in that the molding system installs as two components, which are designated generally as main structure 40 and lower structure 41. These two pieces will preferably be supplied together, and cutting the molding assembly while both pieces are together ensures matching angles upon installation. After the necessary cuts in the molding system are made, main structure 40 and lower structure 41 are separated.

In FIG. 6, reference numeral 49 refers generally to the finished ceiling, while reference numeral 50 refers to the finished wall. As is the case in most construction, the wall and ceiling are constructed of wall panels attached to structural members. The main structure 40 of the molding assembly is placed as shown in the corner where the ceiling meets the wall. Main structure 40 is installed such that upper contact surface 47 is seated against finished ceiling surface 48, and vertical mounting surface 18 is seated against finished wall surface 45. Without lower structure 41 in place, the installer will have access to lower installation flange 8 and will drive fastener 43 through flange 8 and finished wall 50, fastening shaft 44 of fastener 43 sturdily into a structural member.

At this point, the main structure 40 is installed. While lower installation flange 8 is designed, in this embodiment, to be strong enough to hold the main structure 40 in place, this is not the only support for the molding system. The molding system is completed by sliding lower structure 41 into vertical channel 13. Lower structure 41 covers both lower installation flange 8 and fastener 43, and lower decorative face 42 combines with upper decorative face 36 to provide a continuous decorative face from finished wall surface 45 to finished ceiling surface 48. Lower structure 41 also provides support for main structure 40 by filling vertical channel 13 and preventing upper contact surface 47 from falling away from finished ceiling surface 48.

Figure 7:
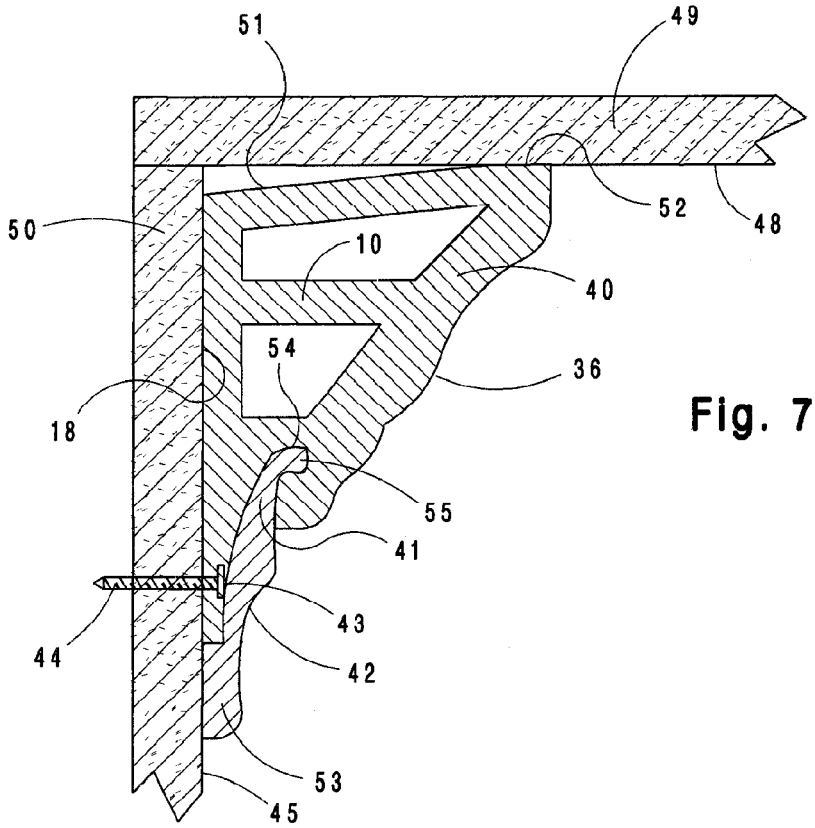
FIG. 7 is a cross sectional view of another embodiment of the present invention in which the system is affixed to a finished wall and against a finished ceiling. The ceiling is fixed and rigid. This figure illustrates a different shape to the top edge of the main structure and a different channel shape at the lower end of the main structure. This figure illustrates the extension of the lower structure below what is necessary to cover the main structure. This extension allows for a larger decorative surface for the molding system.

As in the other embodiments of this invention, the internal structure 10 of the main structure 40 as illustrated in both FIG. 6 and FIG. 7 is only relevant as a means of maintaining the rigidity of the invention in this embodiment.

FIG. 7 illustrates some variations on the embodiment illustrated in FIG. 6, but otherwise functions in much the same way. One difference is that similar to the embodiment shown in FIG. 3 the upper contact surface 52 comprises a much smaller portion of the upper surface of main structure 40 in this embodiment. Upper surface 51 angles down from the horizontal surface as it moves toward vertical mounting surface 18. This provides an advantage in that often the corner where finished wall surface 45 meets finished ceiling surface 48 is not a true 90 degrees. This occurs as finishing materials such as tape and joint compound are built up to finish the joint, and layers of paint accumulate. Having a smaller upper contact surface 52 close to upper decorative face 36 will allow a good seat between upper contact surface 52 and finished ceiling surface 48 even if the corner has significant build up.

Lower attachment flange 8 and lower structure 41 have also been altered in this embodiment in comparison to the arrangement shown in FIG. 6. Here, attachment flange 8 has been made thicker where it joins main structure 40. This is to gain strength during the installation process, before lower structure 41 is installed to complete the structure. In addition, lower structure 41 has been altered to match the revised vertical channel 54. Note that vertical channel 54 now has a notch, which matches a protrusion on lower structure 41. The arrangement shown in FIG. 7 is illustrative of one method for keeping lower structure 41 in place once installed, and it will be understood that this method and other methods in the art may be used for this purpose.

Another facet of the embodiment illustrated in FIG. 7 is the extension of lower decorative face 42 on lower structure 41. Area 53 of lower structure 41 is created to offer an extended area of decoration to the molding assembly. It will therefore be understood that decorative surface 42 of lower structure 41 may be provided in any number of different patterns, designs, lengths, or the like to match surface decoration 36 of main structure 40.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A molding system comprising:

a decorative surface that travels, with variations for a decoratively shaped surface, the hypotenuse of a right triangle formed where an interior wall rises to meet a ceiling, having a consistent profile, barring decoration, as it runs longitudinally along the corner formed by a wall and a ceiling;

a vertical surface that is flat and to be attached to the wall structural members of a vertical wall whose surface extends above the height of the top of the decorative surface, and above the height of the ceiling, thereby offering an attachment point through which a fastener can affix said molding system to said structural wall members, and whose surface extends below the level of the of the bottom of the decorative surface and having a consistent profile along the length of the molding;

a horizontal surface that extends out from the vertical surface at the wall members connecting to the top of the decorative surface;

a vertical channel, consistent and running the length of the molding which has a longer side comprising the vertical surface against the wall members and a shorter side which starts at above the height of the longer side and proceeds vertically such that the vertical channel has a consistent width and terminates below the horizontal surface, where the shorter vertical side terminates and meets the lower edge of the decorative surface whereby a wall panel can be inserted into the vertical channel and against the longer wall of the vertical channel and extend below the molding system to form the wall surface of an interior room; and an internal structure that maintains the spatial relationship between all components and the integrity of all components through installation and use.

2. A molding system as in claim 1 wherein the horizontal surface at the top of the decorative surface is designed to support a nonstructural ceiling resting said horizontal surface.

3. A molding system as in claim 1 wherein the materials used are fire resistant.

4. A molding system as in claim 1 wherein the lower portion of the vertical surface against the wall structural members and comprising the longer side of the vertical channel is used as an additional attachment point by affixing a fastener through said lower portion of the molding system and into said wall structural member.

5. A molding system as in claim 1 additionally comprising a body piece running the length of the molding system and with a consistent profile that fits snugly within the vertical channel allowing for a wall panel whose thickness is less than the vertical channel to be installed and whose portion that extends below the shorter edge of the vertical channel comprises a decorative surface that starts at the lower termination of the main structure's decorative surface and continues, with consistent design as to appear part of a larger decorative face, terminating at the surface of the thinner wall panel.

6. A molding system as in claim 1 wherein the vertical channel is wider than the wall panel is thick by such a thickness as when an additional surface such as ceramic tile is installed on the wall panel there is a continuous appearance where the tile fills in said wider channel to meet the lower edge of the decorative surface of the molding system.

7. A molding system as in claim 1 wherein the decorative surface has a thin layer applied with adhesive such that the decorative surface has the appearance of wood with various levels and types of finishes whereby said layer extends onto the horizontal surface at the upper edge of the decorative surface and into the channel at the lower edge of the decorative surface to convey a continuous finished appearance.

8. A molding system as in claim 1 wherein the decorative surface has an embedded decorative pattern to simulate the texture of wood grain.

9. A molding system as in claim 1 wherein the molding system contains a color throughout the decorative surface and a level of finish or gloss at the decorative surface to provide a desired decorative finished appearance.

10. A crown molding section comprising:

(a) an at least intermittently molded decorative surface;

(b) a rear wall engagement surface;

(c) an upper ceiling tile support surface;

(d) the rear wall engagement surface extending upwardly at least partially beyond the upper ceiling tile support surface and adapted for being primarily secured to a wall near a nonstructural ceiling;

(e) the molded decorative surface extending generally between the rear wall engagement surface and the upper support surface;

(f) at least the outer edge of the upper ceiling tile support surface being adapted to engage the outer surfaces of ceiling tiles; and (g) an internal structure for maintaining the rigidity of said crown molding section.

11. The crown molding section of claim 10 in which the rear wall engagement surface extends downwardly at least partially beyond the decorative surface.

12. The crown molding section of claim 10 additionally comprising a vertical channel provided behind the lower edge of the decorative surface.

13. The crown molding section of claim 10 in which at least the rear engagement surface is formed of a fire resistant material.

* * * * *

UNITED STATES PATENT AND TRADEMARK OFFICE

CERTIFICATE OF CORRECTION

PATENT NO. : 7,997,043 B1
APPLICATION NO. : 12/130912
DATED : August 16, 2011
INVENTOR(S) : Robert MacMillan and Jeremy P. Hoffman It is certified that error appears in the above-identified patent and that said Letters Patent is hereby corrected as shown below:

Column 10, line 31, change “resting said” to read as -- resting on said --

Signed and Sealed this
Eleventh Day of September, 2012

David J. Kappos

David J. Kappos
*Director of the United States Patent and Trademark Office*